US008797136B2

(12) United States Patent
Nakajima et al.

(10) Patent No.: US 8,797,136 B2
(45) Date of Patent: Aug. 5, 2014

(54) LAMINATED COMMON-MODE CHOKE COIL

(71) Applicant: Taiyo Yuden Co., Ltd., Tokyo (JP)

(72) Inventors: Takashi Nakajima, Takasaki (JP); Mika Tamanoi, Takasaki (JP); Kenji Otake, Takasaki (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 0 days.

(21) Appl. No.: 13/717,117

(22) Filed: Dec. 17, 2012

(65) Prior Publication Data

US 2013/0154786 A1 Jun. 20, 2013

(30) Foreign Application Priority Data

Dec. 20, 2011 (JP) ..... 2011-278985

(51) Int. Cl.

| | |
|---|---|
| ***H01F 5/00*** | (2006.01) |
| ***H01F 27/28*** | (2006.01) |
| ***H01F 27/24*** | (2006.01) |
| *H01F 17/00* | (2006.01) |

(52) U.S. Cl.

CPC ..... *H01F 5/003* (2013.01); *H01F 2017/0093* (2013.01); *H01F 17/0013* (2013.01); *H01F 2017/0073* (2013.01)

USPC ..... 336/200; 336/232; 336/233; 336/234

(58) Field of Classification Search

CPC ..... H01F 17/0013; H01F 17/0033; H01F 27/2804; H01F 5/003; H01F 41/046; H01F 27/255; H01F 41/0246; H01F 3/08; B22F 2998/10; B22F 3/02

USPC ..... 336/200, 232, 233, 234, 83

See application file for complete search history.

(56) References Cited

U.S. PATENT DOCUMENTS

| | | | | |
|---|---|---|---|---|
| 7,304,557 | B2 * | 12/2007 | Tsuzuki et al. | 336/200 |
| 7,843,701 | B2 * | 11/2010 | Kudo et al. | 361/760 |
| 8,325,003 | B2 * | 12/2012 | Wu | 336/200 |
| 2002/0064690 | A1 * | 5/2002 | Chen et al. | 428/694 TS |
| 2005/0190036 | A1 * | 9/2005 | Uriu et al. | 336/200 |
| 2009/0003191 | A1 * | 1/2009 | Inuzuka et al. | 369/283 |
| 2011/0181384 | A1 * | 7/2011 | Inuduka et al. | 336/234 |

FOREIGN PATENT DOCUMENTS

| | | | |
|---|---|---|---|
| JP | 2006-319009 | A1 | 11/2006 |
| JP | 2008-159738 | A1 | 7/2008 |

* cited by examiner

*Primary Examiner* — Alexander Talapalatski
*Assistant Examiner* — Kazi Hossain
(74) *Attorney, Agent, or Firm* — Law Office of Katsuhiro Arai

(57) ABSTRACT

A laminated common-mode choke coil offering higher insulation reliability has a glass ceramic layer, two spiral internal conductors facing each other and sandwiching the glass ceramic layer in between, and insulation layers sandwiching the two internal conductors, wherein the glass ceramic layer contains segregated Al regions and the maximum dimension $t_1$ of each segregated Al region in the glass ceramic layer, in the layer-thickness direction, is no more than 80% of the distance $t_0$ between the two internal conductors.

7 Claims, 2 Drawing Sheets

10 Multi-layer common-mode choke coil
11, 12 Internal conductor
13 Glass ceramic layer
20 Segregated Al

| | |
|---|---|
| 10 | Multi-layer common-mode choke coil |
| 11, 12 | Internal conductor |
| 13 | Glass ceramic layer |
| 20 | Segregated Al |

LAMINATED COMMON-MODE CHOKE COIL

BACKGROUND

1. Field of the Invention

The present invention relates to a laminated common-mode choke coil that can be used in various electronic devices.

2. Description of the Related Art

A common-mode choke coil is an electronic component comprising two coiled conductors formed on an insulator and, in particular, a laminated common-mode choke coil is structured in such a way that two spiral conductors are facing each other via an insulator layer. Preferably the insulator layer between the two conductors has a low dielectric constant. Accordingly, glass ceramics is favorably used as the material for this insulator layer. To lower the dielectric constant further, use of silica (quartz) is preferable. In consideration of chemical resistance, etc., however, many common-mode choke coils use not only silica, but also alumina-spiked filler, as the material for glass ceramics.

Patent Literature 1 discloses a laminated common-mode noise filter comprising a non-magnetic layer, two magnetic layers sandwiching the non-magnetic layer, two opposing planar coils embedded in the non-magnetic layer, and external end face electrodes, where it is proposed that, to increase the bonding strength between the external end-face electrodes and magnetic layers, a glass component be contained in the magnetic layers and preferably a glass component be contained also in the non-magnetic layer and base layers for external end-face electrodes.

According to Patent Literature 2, it is proposed that, to increase the impedance of the common-mode component, at least two magnetic layers be provided above and below two coiled conductors, respectively, with two non-magnetic layers provided between the two magnetic layers, while a glass-containing low-dielectric-constant layer be formed between the non-magnetic layers and a glass-containing material of low magnetic permeability be used to form an insulation layer between the two conductors. According to Patent Literature 2, this constitution increases the impedance of the common-mode component because there is a non-magnetic layer between the glass-containing low-dielectric-constant layer and each magnetic layer, which in turn prevents direct contact between the magnetic layer and low-dielectric-constant layer and thereby prevents drop in the magnetic permeability of the magnetic layer.

BACKGROUND ART LITERATURES

[Patent Literature 1] Japanese Patent Laid-open No. 2006-319009

[Patent Literature 2] Japanese Patent Laid-open No. 2008-159738

SUMMARY

With a laminated common-mode choke coil using glass ceramics, Ag or Cu can be used for the internal conductors so that the glass ceramic layer and internal conductors can be sintered at the same time. In particular, Ag is a favorable choice for the internal conductors because it can be sintered in atmosphere. However, Ag presents a concern in that it easily diffuses in the glass ceramic layer and this diffused Ag may lower the insulation property. Recently higher insulation reliability is expected from laminated common-mode choke coils having a glass ceramic layer.

In consideration of the above, an object of the present invention is to provide a laminated common-mode choke coil offering higher insulation reliability.

Any discussion of problems and solutions involved in the related art has been included in this disclosure solely for the purposes of providing a context for the present invention, and should not be taken as an admission that any or all of the discussion were known at the time the invention was made.

After studying in earnest, the inventors of the present invention found that Al would cause the glass component, or specifically alkali metals, boron, Ag in the internal conductors, etc., to melt and segregate easily. By controlling this segregation, therefore, the inventors improved the reliability of laminated common-mode choke coils. In other words, the present invention is as described below.

The laminated common-mode choke coil proposed by the present invention has a glass ceramic layer, two spiral internal conductors facing each other and sandwiching the glass ceramic layer in between, and insulation layers sandwiching the two internal conductors. The glass ceramic layer contains segregated Al regions (which are regions in which Al is segregated at a substantially higher concentration, e.g., at least 1.5 times higher, than that in other areas) and the maximum dimension of each segregated Al region in the glass ceramic layer, in the layer-thickness direction, is no more than 80% of the distance between the two internal conductors.

Preferably the glass ceramic layer contains glass and filler, where the content of Al in the glass is 0.05 to 5 percent by weight.

Also, preferably the internal conductors are made of a conductor material containing silver.

According to the knowledge gained by the inventors of the present invention, segregated Al regions are formed as a result of reaction between Al in the glass and Ag or other conductor material diffused in the glass ceramic layer on one hand, and normally alkali metal on the other. Presence of segregated Al regions means that Ag or other conductor material diffused in the glass ceramic layer has been captured by segregated Al. Accordingly, the presence of segregated Al regions prevents drop in insulation property, which could otherwise occur as the conductor material diffuses in the glass ceramic layer. On the other hand, a segregated Al region itself contains a lot of alkali metal, conductor material, etc., and thus has low resistance, and the resistance value tends to drop as a potential difference is applied. As a result, the insulation reliability of the product will drop if the internal conductors with a potential difference are cross-linked by segregated Al regions. Under the present invention, presence of Al is made a requirement, while the shape and/or size of segregated Al regions is/are specified, in order to allow Ag or other conductor material to be captured by segregated Al while preventing cross-networking and cross-linking of segregated Al regions, thereby improving the reliability of the laminated common-mode choke coil.

In a favorable embodiment of the present invention, the content of Al is specified for easy control of formation of segregated Al regions. In another favorable embodiment, the internal conductors can easily be sintered in atmosphere (in air) because they are made of a conductor material containing silver.

For purposes of summarizing aspects of the invention and the advantages achieved over the related art, certain objects and advantages of the invention are described in this disclosure. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features, and advantages of this invention will become apparent from the detailed description which follows.

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

DESCRIPTION OF THE SYMBOLS

Figure 1:
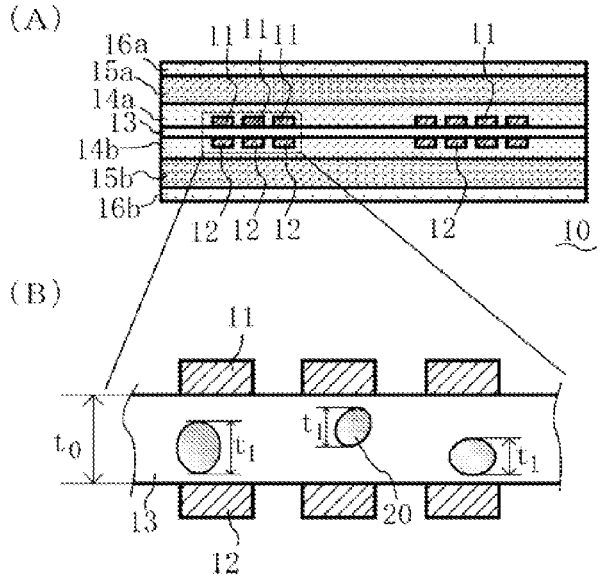
FIG. 1 is a schematic section view of a laminated common-mode choke coil conforming to the present invention, and partially enlarged view of the coil

11, 12: Internal conductor
13: Glass ceramic layer
14 to 16: Insulation layer
20: Segregated Al region

DETAILED DESCRIPTION OF EMBODIMENTS

The present invention is described in detail by referring to the drawings as deemed appropriate. Note, however, that the present invention is not limited to the embodiments illustrated and that, because characteristic features of the invention may be emphasized in the drawings, the scale of each part of the drawings may not be accurate.

FIG. 1 is a schematic section view of a laminated common-mode choke coil conforming to the present invention. FIG. 1 (A) is a general view, while FIG. 1 (B) is a partially enlarged view. Segregated Al regions are not illustrated in FIG. 1 (A), while insulation layers around the internal electrodes 11, 12 are not illustrated in FIG. 1 (B). With a laminated common-mode choke coil 10 under the present invention, two spiral internal conductors 11, 12 are provided in a manner facing each other and sandwiching a glass ceramic layer 13 in between. The internal conductors draw curves or the like that are spiraling or turning in a manner moving away from the center (or moving closer to the center when traced from the other side) or broken lines similar to such curves, where the individual internal conductors 11, 12 are formed roughly on the same plane. The specific shape of the internal conductors can be determined by referring to any prior art of laminated common-mode choke coil as deemed appropriate. The internal conductors 11, 12 are formed by a conductive material, which is generally metal, or more specially Cu, Ag or alloy containing Cu or Ag, and the internal conductors are made preferably of a conductor material containing Ag that can be sintered in an oxidizing ambience, or more preferably of a conductor material containing Ag by 90 percent by weight or more.

The glass ceramic layer 13 is formed in a manner sandwiched by the two internal conductors. Preferably the glass ceramic layer 13 contains glass (hereinafter also referred to as "frit" or "glass frit") and filler (not illustrated) diffused in the glass. A preferred chemical species of filler is quartz (crystalline $SiO_2$), preferred content of filler in the glass ceramic layer 13 is 10 to 35 percent by volume, and filler is diffused in the glass ceramic layer 13 in crystalline form.

Examples of the glass material for the glass ceramic layer 13 include borosilicate glass whose main ingredient is $SiO_2$, and non-borosilicate glass. According to the present invention, Al in particular is contained in the glass ceramic layer 13 as glass material. Al contained in the glass ceramic layer 13 typically constitutes a glass network. The glass ceramic layer 13 may contain, for example, key constituents such as silicate and boron, as well as alkali metals, alkali earth metals, Cu, Zn, Sn, Fe, Ni, Co and Ag, among others.

If boron is contained in the glass ceramic layer, the content of boron in the glass material is preferably 5 to 20 percent by weight based on the amount of $B_2O_3$. If alkali metal is contained in the glass ceramic layer, the content of alkali metal in the glass material is preferably 0.5 to 4 percent by weight based on the amount of alkali meal oxide.

The amount of Al in the glass material in the glass ceramic layer 13 is preferably 0.05 to 5 percent by weight, or more preferably 0.1 to 2 percent by weight, based on the amount of $Al_2O_3$. The lower the content of Al, the better in terms of smaller segregation of Al as explained later. The higher the content of Al, on the other hand, the better in terms of easy capturing of conductor material that may diffuse from the internal conductors 11, 12 to the glass ceramic layer 13.

The thickness of the glass ceramic layer 13 can be set freely as deemed appropriate according to the designed size, etc., of the laminated common-mode choke coil, where examples include, but are not limited to, 5 to 25 μm or so. The thickness of the glass ceramic layer 13 is equal to the distance between the two internal conductors 11, 12.

The glass ceramic layer 13 contains segregated Al regions 20.

Segregated Al regions 20 are constituted by a glass material that may contain, in addition to Al, any element constituting the glass (silicate, boron, alkali metal, alkali earth metal, etc.) and Ag constituting the internal electrodes. It may also contain trace amounts of Fe, Ni, Cu and Zn that constitute a magnetic component which is one of constituents of the common-mode choke coil. In particular, segregated Al regions contain a lot of alkali metal and Ag compared to the main phase of glass (hereinafter also referred to as "main phase").

Segregated Al regions 20 are formed by the Al component and alkali metal in the glass ceramic layer 13 and conductor material diffused from the internal conductors 11, 12 reacting together. Since generation of segregated Al regions 20 causes the conductor material diffused in the glass ceramic layer 13 to accumulate, presence of segregated Al regions 20 is not necessarily bad, as it improves the insulation property of the glass ceramic layer 13. However, if segregated Al regions 20 are too large in size, multiple areas of segregated Al regions 20 may contact each other to form a network, thereby causing the insulation property of the glass ceramic layer 13 to drop significantly. Based on the above viewpoint, the present invention is such that segregated Al regions 20 are present in the glass ceramic layer 13 and the maximum dimension of each segregated Al region 20 in the layer-thickness direction is no more than 80%, or preferably in a range of 10 to 70%, of the distance between the two internal conductors 11, 12. In FIG. 1 (B), the distance between the two internal conductors 11, 12 is indicated by $t_0$ and "layer-thickness direction dimension" of each segregated Al region is indicated by $t_1$. The cross sectional shape of each segregated Al region may be approximately oval, circular, irregular, etc., although Al is distributed throughout the main phase and segregated Al forms segregated Al regions, the boundary of which is defined based on the definition of segregated Al regions. Segregated Al regions contain substantially the same components as in the main phase, but the concentrations of some of the components are different from those in the main phase as explained above. In some embodiments, segregated Al regions are not in contact with each other in a direction perpendicular to the thickness direction.

Figure 2:
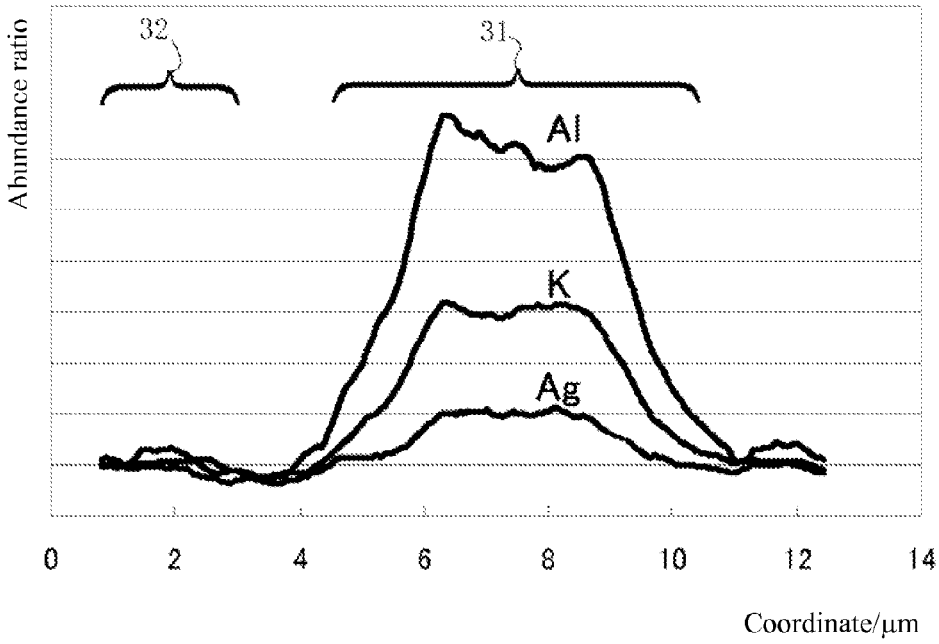
FIG. 2 is a schematic diagram showing an example of element mapping of segregated Al regions and the surrounding area based on SEM-EDS analysis

Presence of segregated Al regions in the glass ceramic layer 13 can be confirmed, and the aforementioned dimension $t_1$ of a segregated Al region present can be measured, by polishing a measurement sample to a mirror surface and then performing SEM-EDS analysis of the polished surface. FIG. 2 is a schematic diagram of SEM-EDS mapping showing the abundance ratios of Al, K and Ag in segregated Al regions and the surrounding area. In the measurement to create this mapping, the glass ceramic layer 13 is scanned in the layer-thickness direction to plot the abundance ratios of the aforementioned elements. The element distribution in segregated Al regions 20 is expressed by reference numeral 31, while the element distribution in the main phase of the glass ceramic layer 13 around segregated Al regions 20 is expressed by reference numeral 32. According to the present invention, an area indicating an Al abundance ratio of at least 1.5 times the abundance ratio of Al detected in the main phase is recognized as segregated Al regions. The length of each segregated Al region, thus defined, in the layer-thickness direction corresponds to the aforementioned dimension $t_1$.

As a method to reduce the aforementioned dimension $t_1$ in each segregated Al region 20, the manufacturing material of the glass ceramic layer 13 may be pulverized, the amount of Al may be adjusted to the favorable range mentioned above, or the rate of rise in temperature may be quickened during sintering, for example, or any of these methods may be combined as deemed necessary.

The laminated common-mode choke coil 10 proposed by the present invention has insulation layers in addition to the glass ceramic layer 13. There are at least insulation layers sandwiching the two internal conductors 11, 12. In the mode shown in FIG. 1 (A), insulation layers 14*a*, 14*b* are sandwiching the internal conductors 11, 12. The insulation layers need to be only electrically insulating, and their material, constitution, etc., can be determined by referring to any prior art of laminated common-mode choke coil, as deemed appropriate. For example, the material for insulation layers 14*a*, 14*b* that directly contact the internal conductors 11, 12 may be constituted by the same glass ceramic material used for the aforementioned glass ceramic layer 13, or by any of various types of ferrites that has been sintered. In FIG. 1, multiple layers denoted by reference numerals 14, 15 and 16 are shown outside the internal conductors 11, 12. This assumes, for example, the possibility that magnetic layers and non-magnetic layers can be combined as deemed appropriate for insulation layers, and does not limit the scope of the present invention in any way due to the number of layers or material or thickness of the insulation layer.

In addition to the above, the laminated common-mode choke coil 10 proposed by the present invention may have various other constitutions by applying any prior art of laminated common-mode choke coil as deemed appropriate. For example, external terminals and wirings for electrically connecting the external terminals and internal conductors 11, 12, though not illustrated in FIG. 1, may be provided.

Figure 3:
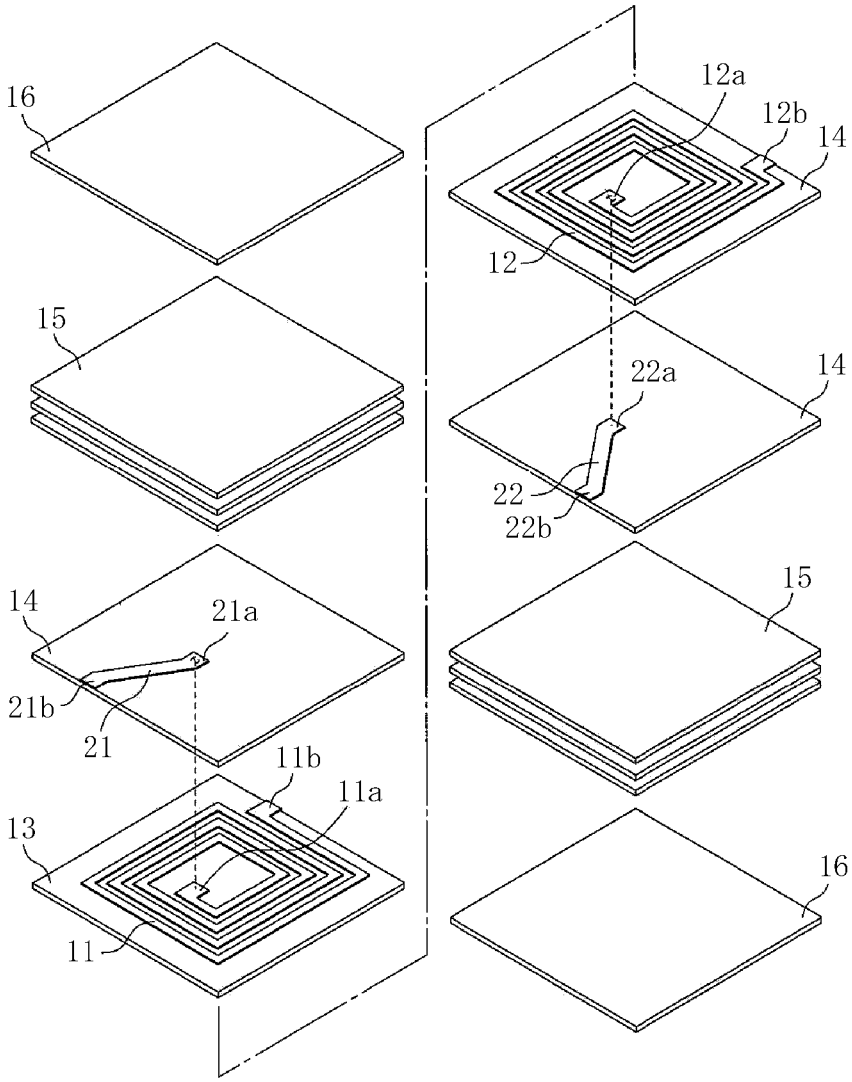
FIG. 3 is a schematic exploded view of a laminated common-mode choke coil conforming to the present invention

As for the manufacturing method of the laminated common-mode choke coil, any prior art may be applied as deemed appropriate, in addition to using the specified material mentioned above for the glass ceramic layer 13. FIG. 3 is a schematic exploded view of a laminated common-mode choke coil conforming to the present invention. For each layer shown in FIG. 1 or FIG. 3, the applicable material such as magnetic material, non-magnetic material, glass material or filler is mixed with resin (binder) to prepare a slurry or paste to manufacture a sheet 13 to 16 corresponding to each layer.

A general method to manufacture the glass ceramic layer 13 sandwiched by the internal conductors 11, 12 is to knead and mix crushed glass material with binder in the presence of solvent, to obtain a slurry. Glass material may be crushed by applying a bead mill or any other known crushing machine. The value of d50 of crushed glass material is preferably 3 μm or less, or more preferably 1.5 μm or less, where the lower limit is not specifically limited, but a favorable value of the lower limit is 0.5 μm. By crushing the glass material to the aforementioned degree, it becomes easy to control the size of segregated Al regions 20 to a specified range. From the obtained slurry, green sheets can be obtained using the doctor blade method, etc.

Internal conductor patterns are formed on the green sheets.

Internal conductor patterns can be formed by, for example, printing on the aforementioned green sheets a paste, etc., containing silver powder or other internal conductor material.

At least one of the opposing internal conductors 11, 12 (internal conductor 11 in FIG. 3) is formed on the green sheet for the aforementioned glass ceramic layer 13. The green sheet 14 on which the other internal conductor 12 is formed needs to be only an insulation layer, where the insulation layer may be of the same material as the glass ceramic layer 13 or it may be formed with a different magnetic material or non-magnetic material.

When forming the internal conductors 11, 12, via holes 11*a*, 21*a*, 12*a*, 22*a* and external terminals 11*b*, 21*b*, 12*b*, 24*b* can be formed as deemed appropriate, where any prior art may be applied as deemed appropriate for the methods of forming these holes and terminals.

Furthermore, green sheets for the outer insulation layers 15, 16, etc., are manufactured using specified materials, respectively, after which the sheets are stacked and sintered. When sintering, increasing the rate of rise in temperature is advantageous in terms of generation of segregated Al regions, but doing so makes the chip more prone to cracking. Accordingly, it is desirable that the rate of rise in temperature be controlled to a range of 300 to 1200° C./h. The sintering temperature can be changed as deemed appropriate according to the material, and may be set to around 900° C., for example.

Example

The present invention is explained more specifically below using an example. It should be noted, however, that the present invention is not at all limited to the embodiments described in this example.

(Material for Glass Ceramic Layer)

As the material for glass ceramic layer, 75 percent by volume of glass frit, prepared by 77.5 percent by weight of $SiO_2$, 20 percent by weight of $B_2O_3$, 2 percent by weight of $K_2O$, and 0.5 percent by weight of $Al_2O_3$ in equivalent oxides, and 25 percent by volume of quartz used as filler, were used. The ingredients were crushed to 1.5 μm (value of d50) in a bead mill. $ZrO_2$ balls, $Al_2O_3$ balls, etc., can be used as crushing medium, and $ZrO_2$ balls were used in this example. Dispersant was added as necessary. Ethanol, toluene, methyl ethyl ketone, etc., can be used as dispersion medium, for example, and ethanol was used in this example.

(Manufacturing of Green Sheet for Glass Ceramic Layer)

A slurry was obtained by mixing and kneading 100 parts by weight of the above material, 300 parts by weight of solvent, 200 parts by weight of binder, and dispersant and plasticizer, and a green sheet was obtained from this slurry using the doctor blade method. $ZrO_2$ balls, $Al_2O_3$ balls, etc., can be used as mixing medium, and $ZrO_2$ balls were used in this example. Polyvinyl butyral resin, methacrylate resin, etc., can be used as binder, for example; dibutyl phthalate, dioctyl phthalate, etc., can be used as plasticizer, for example; and ethanol, toluene, methyl ethyl ketone, etc., can be used as solvent, for example; and dispersant may be added, as necessary. In this example, polyvinyl butyral resin was used as binder, dibutyl phthalate was used as plasticizer, and ethanol was used as solvent.

(Formation of Internal Conductor Patterns)

Next, a conductive paste containing Ag conductor metal was printed on the obtained green sheet by means of screen printing, etc., to form spiral conductors and conductors to be connected to the external terminals. The spiral conductors and conductors to be connected to the external terminals were connected through holes made in the green sheet.

(Formation of Insulation Layer)

A slurry was obtained by mixing and kneading 200 parts by weight of magnetic material (ferrite), 300 parts by weight of solvent, 200 parts by weight of binder, and small amounts of dispersant and plasticizer, and a green sheet was obtained from this slurry using the doctor blade method. $ZrO_2$ balls, $Al_2O_3$ balls, etc., can be used as mixing medium, and $ZrO_2$ balls were used in this example. Polyvinyl butyral resin, methacrylate resin, etc., can be used as binder, for example, and polyvinyl butyral resin was used in this example. Dibutyl phthalate, dioctyl phthalate, etc., can be used as plasticizer, for example, and dibutyl phthalate was used in this example. Ethanol, toluene, methyl ethyl ketone, etc., can be used as solvent, for example, and ethanol was used in this example. In this example, the items denoted by reference numerals 13, 14 and 15 in FIG. 1 were all constituted by the same material.

On parts of the green sheet for insulation layer, 21*a*, 22*a* and patterns for the external terminals 21*b*, 24*b* were formed.

(Stacking and Sintering)

From the bottom, a green sheet for insulation layer, green sheet for insulation layer on which the external terminal 24*b* was formed, green sheets for glass ceramic layer (2 sheets) on which spiral internal conductor patterns were formed, green sheet for insulation layer on which the external terminal 21*b* was formed, and green sheet for insulation layer, were stacked in this order. The sheets were pressure-bonded and degreased in air, and then heated to 900° C. at a rate of rise in temperature of 600° C./h in air, after which the stack was held at this temperature for 2 hours and then cooled to form a sintered laminate.

After sintering, external terminals were provided to obtain a laminated common-mode choke coil.

(Evaluation of Segregated Al Regions)

A cross-section of the obtained laminated common-mode choke coil was observed with an electron microscope to confirm that the interval $t_0$ between the two internal conductors 11, 12 was 10 μm.

Using the aforementioned measurement method, presence of segregated Al regions was confirmed and the thickness $t_1$ of each segregated Al region in the layer-thickness direction was measured. At least five counts of segregated Al regions were present in the observed area of 80 μm×80 μm on the glass ceramic layer 13, and the maximum value of their $t_1$ was 5 μm.

(Evaluation of Reliability)

The insulation reliability of the obtained laminated common-mode choke coil was evaluated. In the reliability test, 10 V of voltage was applied for 1000 hours at 125° C. to 40 chips which were targets for measurement to measure resistance, and chips whose resistance dropped to below 100 MΩ were considered defective.

Various samples were prepared by adjusting the composition of the glass ceramic layers and level of crushing, and their reliability was evaluated.

In Table 1 shown later, "Amount of filler" indicates the amount of quartz used as filler, "Amount of frit" indicates the amount of glass, and "Frit composition" indicates the amount (in equivalent oxide weight) of each element contained in the glass (frit). When the amount of Al was increased or decreased, the processing time on the bead mill during the manufacture of the glass ceramic layer was increased or decreased to control the material particle size. Except for this adjustment, samples were prepared in the same manner as described above. The results are shown in Table 1.

TABLE 1

| Amount of filler vol % | Amount of frit vol % | Frit composition $SiO_2$ wt % | $B_2O_3$ wt % | $K_2O$ wt % | $Al_2O_3$ wt % | Material particle size μm | Size of segregated Al μm | Number of chips of defective insulation % |
|---|---|---|---|---|---|---|---|---|
| 25 | 75 | 78.80 | 18.70 | 2.00 | 0.5 | 4.3 | 11.2 | 100 |
| 25 | 75 | 78.80 | 18.70 | 2.00 | 0.5 | 3.7 | 8.5 | 17.5 |
| 25 | 75 | 78.80 | 18.70 | 2.00 | 0.5 | 2.3 | 7.2 | 0 |
| 25 | 75 | 78.80 | 18.70 | 2.00 | 0.5 | 1.5 | 5.0 | 0 |
| 25 | 75 | 78.80 | 18.70 | 2.00 | 0.5 | 0.9 | 4.2 | 0 |
| 25 | 75 | 79.30 | 18.70 | 2.00 | 0 | 1.5 | | 10 |
| 25 | 75 | 79.25 | 18.70 | 2.00 | 0.05 | 1.5 | 3.9 | 0 |
| 25 | 75 | 79.20 | 18.70 | 2.0 | 0.1 | 1.5 | 4.1 | 0 |
| 25 | 75 | 78.80 | 18.70 | 2.0 | 0.5 | 1.5 | 5.1 | 0 |
| 25 | 75 | 78.30 | 18.70 | 2.0 | 1 | 1.5 | 5.2 | 0 |
| 25 | 75 | 77.30 | 18.70 | 2.0 | 2 | 1.5 | 5.5 | 0 |
| 25 | 75 | 74.30 | 18.70 | 2.0 | 5 | 1.5 | 7.9 | 0 |
| 25 | 75 | 69.30 | 18.70 | 2.0 | 10 | 1.5 | 10 or more (network was formed) | 100 |

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments. Further, in this disclosure, an article "a" may refer to a species or a genus including multiple species, and "the invention" or "the present invention" may refer to at least one of the embodiments or aspects explicitly, necessarily, or inherently disclosed herein. In this disclosure, any defined meanings do not necessarily exclude ordinary and customary meanings in some embodiments.

The present application claims priority to Japanese Patent Application No. 2011-278985, filed Dec. 20, 2011, the disclosure of which is incorporated herein by reference in its entirety.

It will be understood by those of skill in the art that numerous and various modifications can be made without departing from the spirit of the present invention. Therefore, it should be clearly understood that the forms of the present invention are illustrative only and are not intended to limit the scope of the present invention.

We claim:

1. A laminated common-mode choke coil having a glass ceramic layer, two spiral internal conductors facing each other and sandwiching the glass ceramic layer in between, and insulation layers sandwiching the two internal conductors;

wherein the glass ceramic layer contains segregated Al regions where a concentration of Al is substantially higher than that in other areas of the glass ceramic layer, and a maximum dimension of each segregated Al region in the glass ceramic layer, in a layer-thickness direction, is no more than 80% of a distance between the two internal conductors; and wherein the glass ceramic layer contains Al in an amount of 0.05% to 5% by weight as $Al_2O_3$ relative to a glass material contained in the glass ceramic layer, and a median size of particles constituting the glass material is 3 μm or less.

2. A laminated common-mode choke coil according to claim 1, wherein the glass ceramic layer contains glass and filler.

3. A laminated common-mode choke coil according to claim 1, wherein the internal conductors are made of a conductor material containing silver.

4. A laminated common-mode choke coil according to claim 2, wherein the internal conductors are made of a conductor material containing silver.

5. A laminated common-mode choke coil according to claim 1, wherein the distance between the two internal conductors is a thickness of the glass ceramic layer which is about 5 μ to about 25 μm.

6. A laminated common-mode choke coil according to claim 1, wherein the segregated Al regions are reaction products of an Al component and alkali metal in the glass ceramic layer and conductor material diffused from the internal conductors.

7. A laminated common-mode choke coil according to claim 1, wherein the segregated Al regions contain higher concentrations of alkaline metal and Ag than those in the other areas of the glass ceramic layer.

* * * * *